United States Patent [19]

Clements

[11] 4,399,918

[45] Aug. 23, 1983

[54] TAG PIN DEVICES

[75] Inventor: Stanley Clements, Orangeburg, N.Y.

[73] Assignee: Ben Clements & Sons, Inc., South Hackensack, N.J.

[21] Appl. No.: 239,701

[22] Filed: Mar. 2, 1981

[51] Int. Cl.[3] ..... A47F 5/08

[52] U.S. Cl. ..... 211/113; 223/85; 24/150 FP

[58] Field of Search ..... 211/113, 45, 46; 223/85; 24/150 FP; 248/340

[56] References Cited

U.S. PATENT DOCUMENTS

| | | | |
|---|---|---|---|
| 2,985,006 | 5/1961 | Du Bois | 24/150 FP |
| 3,103,666 | 9/1963 | Bone | 24/150 FP |
| 3,215,385 | 11/1965 | Rockland | 211/113 X |
| 3,528,590 | 9/1970 | Nathanson | 223/85 |
| 4,034,902 | 7/1977 | Grillo | 248/340 X |
| 4,183,894 | 1/1980 | Paradis | 24/150 FP X |
| 4,347,932 | 9/1982 | Furutu | 206/343 |

FOREIGN PATENT DOCUMENTS

| | | | |
|---|---|---|---|
| 729344 | 3/1966 | Canada | 211/113 |
| 1452928 | 10/1976 | United Kingdom | 223/85 |

*Primary Examiner*—Ramon S. Britts
*Assistant Examiner*—Peter A. Aschenbrenner
*Attorney, Agent, or Firm*—Blum, Kaplan, Friedman, Silberman & Beran

[57] ABSTRACT

Pegboard attachments for supporting a garment or other lightweight article on a Pegboard for display are so constructed the garments may be joined to the attachments which, in turn, may be joined to a peg without danger of the attachments slipping from the peg. Moreover, where desired, the attachments can be produced in a form such that they can be rolled up and fed to a suitable device for separating the attachments from each other and joining successive attachments to garments or other lightweight items.

5 Claims, 4 Drawing Figures

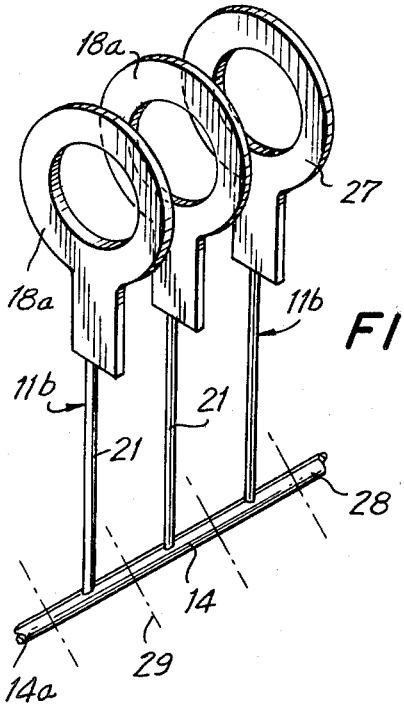
FIG. 4
FIG. 1
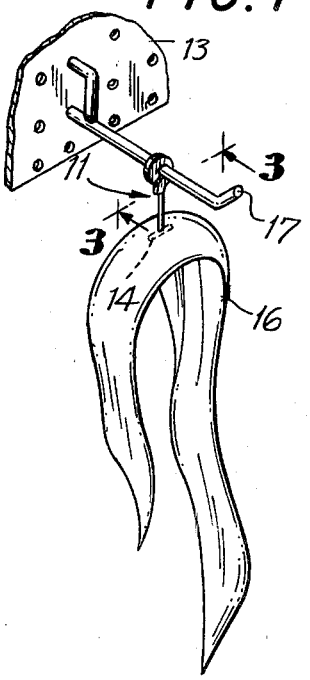
FIG. 3
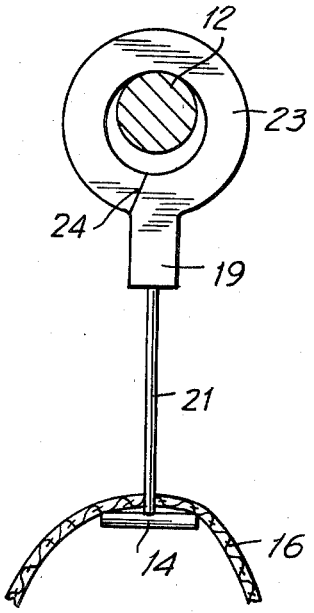
FIG. 2
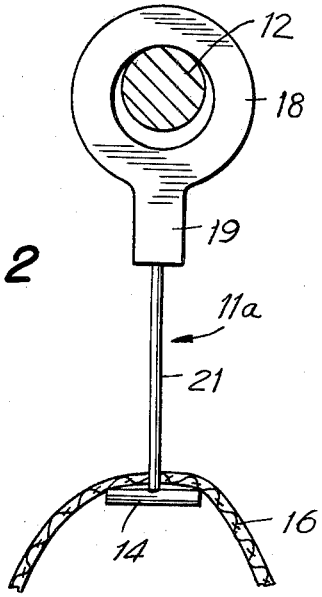

TAG PIN DEVICES

BACKGROUND OF THE INVENTION

Pegboard attachments for supporting a garment or other lightweight item from a peg to be mounted on a pegboard are well known. In general, the attachments are of molded resin and are produced in a form in which they are joined together and which requires that the attachments be separated from each other prior to joining each of the attachments to a corresponding item.

In general, attachments of the prior art have each comprised a looped portion which fits over the peg, and a crossbar for supporting the garment or other item, the crossbar being joined to the loop by an arm extending radially from the loop. The loop itself is in the form of a question mark, having a slot therethrough which is wide enough so that the loop can be hung over a peg from the side of the peg rather than from the end of the peg. While this is an undoubted convenience, particularly where a plurality of loops is to be hung over a peg, nevertheless the construction gives rise to difficulties. The first of these difficulties is that the end of the loop of one attachment may enter another loop and become entangled therewith. This makes it necessary to disentangle and keep separate attachments being prepared for use. The second difficulty is that where the attachments joined to garments are to be supported from a peg during shipment, the attachments can slip sideways from the peg and be separated therefrom. The present invention is intended to overcome these difficulties.

SUMMARY OF THE INVENTION

In a first embodiment of the invention, a Pegboard attachment for supporting a garment or other lightweight item from a peg to be mounted on a Pegboard comprises a closed loop for supporting the attachment on a peg and a crossbar for supporting a garment, the crossbar being joined to the closed loop by an arm extending radially from the loop. The crossbar and its corresponding radial arm are in the form of a letter T. A plurality of Pegboard attachments may be joined together, preferably at the crossbars thereof during manufacture. The attachments are then separated from each other for separate use, a suitable device being used for the purpose. The preferred material for the Pegboard attachments is a synthetic resin.

In a second embodiment, the loop has a narrow slit therethrough, the slit being too narrow to permit passage of a peg through the slit when the loop is in its normal planar configuration, and the thickness of the loop and flexibility of the resin are such that the edges of the loop can be forced apart to permit passage of the peg through the slit.

Preferably, the crossbar is either perpendicular to or in the plane of the loop.

Accordingly, an object of the present invention is a Pegboard attachment for supporting lightweight articles or garments on a peg mounted on a Pegboard, said attachments being designed to minimize any tendency to become entangled with other attachments.

Another object of the present invention is a Pegboard attachment for supporting garments or other lightweight articles from a peg mounted on a Pegboard which can be shipped mounted on a peg without danger of becoming separated from said peg.

A further object of the present invention is a Pegboard attachment for supporting garments or other lightweight articles from a peg to be mounted on a Pegboard where said attachment is designed to minimize any tendency to become separated from said peg in a direction other than over the end of the peg.

An important object of the present invention is a Pegboard attachment for supporting garments or other lightweight articles from a peg to be mounted on a Pegboard where the Pegboard attachment includes a portion forming a complete loop so that said attachment can be joined with a peg only by slipping the loop of said attachment over the end of a peg.

Yet another object of the present invention is a Pegboard attachment for supporting a garment or other lightweight article from a peg mounted on a Pegboard where said attachment has a closed loop having a narrow slit therein and said loop is sufficiently flexible so that the edges of said slit can be forced apart to allow joining the attachment to a peg or separating the attachment from a peg by means other than slipping said loop over the end of said peg.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a Pegboard attachment in accordance with the present invention supported from a peg mounted on a Pegboard;

FIG. 2 is an elevational view of a second embodiment of the present invention supporting a garment;

FIG. 3 is an enlarged elevational view taken along lines 3—3 of FIG. 3 of the Pegboard attachment of the present invention, supporting a garment; and FIG. 4 is a perspective view of an assembly of Pegboard attachments as molded and prior to being cut apart for use.

BRIEF DESCRIPTION OF THE PREFERRED EMBODIMENTS

In FIG. 1, a Pegboard attachment in accordance with the present invention is indicated generally by the reference numeral 11. Said attachment is supported by peg 12 and the peg is mounted on Pegboard 13. Pegboard attachment 11 has a crossbar 14 from which hangs a scarf 16. As is evident, more than one Pegboard attachment can be supported from peg 12 merely by slipping the attachment over end 17 of the peg.

In the embodiment shown in FIG. 2, Pegboard attachment 11*a* has a closed loop 18, is attached to crossbar 14 by means of an arm or filament 21 extending radially from loop 18 to crossbar 14. The arm consists of an enlarged flat portion 19 and a rod portion 21. Loop 18 and flat portion 19 are generally planar and rod portion 21 lies essentially in the same plane as does crossbar 14 in the embodiment of FIG. 2. As is evident, there is no possibility of loop 18 becoming entangled with the loops of adjacent attachments as is the case where the loop has an opening therein large enough to accommodate the loop of another attachment. This results from the curvature of loop 18 which permits two attachments to cam over each other.

Where several items are supported by Pegboard attachments from a single peg, it occasionally becomes desirable to remove one of the attachments without removing those which are closer to the end of the peg. The embodiment of FIGS. 1 and 3 makes such a step possible. In this embodiment loop 23 is normally closed but it has therein a narrow slit or cut 24. Moreover, loop 23 is of a sufficiently flexible construction so that the opposing edges of slit 24 can be forced apart sufficiently so that peg 12 can pass through the slit, thereby making it possible to place an additional attachment on the peg or remove an attachment from the peg without disturbing those attachments which are close to the end 17 of the peg.

Pegboard attachments are generally molded in assemblies and the individual attachments are preferably joined to each other at the crossbars thereof. FIG. 4 shows an assembly 27 of Pegboard attachments 11*b* joined together by the molding of crossbars 14 into a common runner 28. In effect, the crossbars of adjacent attachments are joined end to end. Prior to use the attachments are separated from each other by cutting along the dotted lines 29, forming crossbars 14*a* attached to arms 21. As will be noted, crossbars 14*a* are perpendicular to the planes of loops 18*a*. As is evident, the configurations of FIGS. 2 and 3 in which the crossbars lie in the planes of the loops can be similarly molded in assemblies either with a common runner, which is cut into crossbars, or with a separate runner bar joined to each of the crossbars, (not shown) such as is used in the assemblies of attachments illustrated in U.S. Pat. No. 3,733,657 (see runner bar 8 and necks 10 therein) which is incorporated herein as if fully set forth.

For convenience in storing, shipping and feeding the attachments to a device for separating the attachments from each other, assemblies 27 can be rolled up and, if desired, rolled around a core or spool. A suitable tool can be utilized to feed the attachments, one by one, cutting off each attachment at lines 29 and inserting the resulting crossbars into a garment 16.

The attachment and assembly of attachments disclosed herein can be molded of a suitable plastic resin in a known manner. The resin is of sufficient flexibility to permit controlling of an assembly of attachments of FIG. 4 at the joined crossbars.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also understood that the following claims are intended to cover all of the generic and specific features of the invention herein described and all statements of the scope of the invention which, as a matter of language, might be said to fall therebetween.

What is claimed is:

1. A Pegboard attachment for supporting a lightweight article on a peg of a Pegboard, said attachment comprising an essentially planar annulus having a central opening dimensioned for receipt of a peg therethrough, an arm extending generally radially from said annulus and in the same plane therewith, and a crossbar at the outer end of said arm, said crossbar with said arm having the shape of a T, means joining said attachment with at least one other such Pegboard attachment in the region of said crossbar into an assembly of attachments, said annulus, said arm, said crossbar and said joining means being intergrally formed of molded resin, said crossbars in joined state lying in a continuous line.

2. The Pegboard attachment as defined in claim 1, wherein said annulus has a narrow slit therein, and is of sufficiently flexible construction so that the edges of said slit can be forced apart for permitting the traverse of a Pegboard peg therethrough and thereby making it possible to place said attachment on a peg or remove said attachment from a peg without inserting the end of said peg through said central opening or removing the end of said peg through said central opening.

3. The Pegboard attachment as defined in claim 1 or 2, wherein said essentially radial arm includes a flat portion extending from said annulus and a rod shaped portion extending from said flat portion.

4. The Pegboard attachment as defined in claim 1, wherein said joined crossbars of said assembly is formed to permit rolling of an assembly of a plurality of said attachments into a roll for ease of handling.

5. The Pegboard attachment as defined in claim 1 or 2, wherein said annulus and said crossbar lie in essentially normal planes.

* * * * *